US005634523A

United States Patent [19]

Kobayashi et al.

[11] Patent Number: 5,634,523

[45] Date of Patent: Jun. 3, 1997

[54] BLADE DEVICE

[75] Inventors: Takeshi Kobayashi, Hirakata; Haruo Tomozaki, Kurume, both of Japan

[73] Assignee: Kabushiki Kaisha Komatsu Seisakusho, Tokyo, Japan

[21] Appl. No.: 564,268

[22] PCT Filed: Jun. 24, 1994

[86] PCT No.: PCT/JP94/01022

§ 371 Date: Dec. 27, 1995

§ 102(e) Date: Dec. 27, 1995

[87] PCT Pub. No.: WO95/01482

PCT Pub. Date: Jan. 12, 1995

[30] Foreign Application Priority Data

Jun. 29, 1993 [JP] Japan ..... 5-184420
Nov. 12, 1993 [JP] Japan ..... 5307253

[51] Int. Cl.[6] ..... E02F 3/76

[52] U.S. Cl. ..... 172/818; 172/821

[58] Field of Search ..... 37/117.5; 172/818, 172/819, 820, 821, 822, 812, 826, 827, 832, 804

[56] References Cited

U.S. PATENT DOCUMENTS

| | | | |
|---|---|---|---|
| 3,901,329 | 8/1975 | Eftefield | 172/822 |
| 4,081,036 | 3/1978 | Yokoyama | 172/821 |
| 4,083,414 | 4/1978 | Yokoyama et al. | 172/821 |
| 4,424,871 | 1/1984 | Stickney | 172/821 |
| 4,848,483 | 7/1989 | Heiple | 172/821 |

FOREIGN PATENT DOCUMENTS

| | | | |
|---|---|---|---|
| 1115514 | 1/1982 | Canada | 172/821 |
| 51-18103 | 2/1976 | Japan . | |
| 60-165549 | 11/1985 | Japan . | |

*Primary Examiner*—Terry Lee Melius
*Assistant Examiner*—Robert Pezzuto
*Attorney, Agent, or Firm*—Armstrong, Westerman, Hattori, McLeland & Naughton

[57] ABSTRACT

A blade device, wherein the angling angle of a blade can be increased and the blade width at the maximum angling is smaller than the chassis width without setting the mount position of the blade too far from a chassis. The connecting position of a joint for connecting a frame and a blade deviates from the crosswise center X—X of a chassis; and an actuator for pivotally moving the blade forward or backward is attached to the frame. As such, good workability of the blade device and good transportability of an earth-moving machine to which the blade device is operably coupled can be obtained.

3 Claims, 9 Drawing Sheets

BLADE DEVICE

BACKGROUND OF THE INVENTION

1. Field of the Invention

The present invention generally relates to a blade device. More particularly, this invention relates to a blade device of an angledozer or a tiltdozer as an earth-moving machine, such as, a bulldozer.

2. Description of the Relevant Art

An example of a blade device in a conventional earth moving machine (e.g., a bulldozer; see, e.g., Japanese Utility Model Application Laid-Open No. 59-144063) is shown in FIG. 11. Another example of such conventional earth moving machine (see, e.g., Japanese Utility Model Application Laid-Open No. 56-68040) is shown in FIGS. 12 and 13. In such conventional devices, as shown in FIG. 13, a frame 41 is swingably supported at the rear end thereof by a chassis 40 through pins 42, and a boss portion 47 fixed at the leading center of the frame 41 is swingably connected to a blade 44 through a ball and socket joint 43. Brackets 45 fixed on the right and left sides of the frame 41 and the chassis 40 are connected by right and left lifting actuators 46 through pins. The blade 44 is moved up and down by extending and contracting the lifting actuators 46. Furthermore, the brackets 45 of the frame 41 and the blade 44 are connected by two right and left angling actuators 50 through ball and socket joints 48. By extending and contracting these two angling actuators 50 separately, the blade 44 is angled on the ball and socket joint 43 as shown in dash lines in FIG. 12.

In the example shown in FIG. 11, a tilting actuator 52 is provided through a ball and socket joint between a center bracket 51 fixed at the leading center of the frame 41 and the back surface of the blade 44. On the other hand, in the example shown in FIG. 12, a substantially triangular tilting lever 56 is attached through a ball and socket joint between the center bracket 51 and the back surface of the blade 44, and a tilting actuator 52 is attached to a third end of the tilting lever 56 through a ball and socket joint. In both these examples, the blade 44 is tilted by the extension and the contraction of the tilting actuator 52. If the width of the machine body 40 and the width of the blade 44 are respectively taken as B0 and B1, B0 is smaller than B1.

Although an angling angle β1 shown in FIG. 12 is normally set at a maximum angle of approximately 25° in such conventional blade devices, since this value is small, the following problems arise. One of such problems as shown in FIG. 14, is that a substantial amount of earth and sand windrow S from the blade 44 is likely to be produced by the small angling angle. Furthermore, a smooth earth and sand flow T is not produced depending on the soil; and therefore, workability in backfilling of a ditch or the like is reduced.

As to another problem, since a width B of the blade 44 at the maximum angling angle is larger than a width BO of the chassis 40 (as shown in FIG. 15), the machine with the blade 44 attached cannot be loaded onto a truck having a rear deck width B2 which is a little larger than the chassis BO. In such a case, prior to transporting the machine, it will be necessary to detach the blade 44 in order to load the machine onto the truck. After transporting the machine, it will be necessary to again attach the blade 44 to the machine. In accomplishing such cumbersome procedures, additional man-hours will be required.

Accordingly, as shown in FIG. 16, a maximum angling angle β2 is required to be made wider in order to obtain a width B6 of the blade 44, which is smaller than the chassis width BO for the purpose of improving transportability. In this case, it is necessary to increase the stroke of the angling actuators 50 by positioning a pivot center 53 of the blade 44 ahead of the chassis 40. Therefore, when the angling angle is increased in the conventional structure, the distance between the blade 44 and the chassis 40 is increased.

However, as shown in FIG. 17, if the length from the center of a drive tumbler 54 to the front end of the blade 44, the length from the center of the drive tumbler 54 to the center of gravity G of the machine, and the weight of the machine are taken as Lf, Lw and W, respectively, since an edge force F of the blade 44 equals (Lw/Lf)x W, such edge force F decreases as the length Lf increases; thereby, causing a problem due to a decrease in the operation capability of the machine. In addition, since a length L1 of such conventional blade device also increases with the increase of the length Lf, the blade change amount with respect to the amount of control by the operator increases, and therefore, it is difficult to control the blade 44 of the conventional blade device. Furthermore, the stroke of the angling actuators 50 is lengthened, and rods of the angling actuators consequently buckle. In order to prevent such buckling, an increase in the actuator thrust is essential, which however increases the production cost. Also, since the length of the machine is increased, the weight is increased and the production cost thereof is further increased.

Although other conventional blade devices equipped with angling actuators are disclosed in Japanese Utility Model Application Publication Nos. 56-13415 and 56-47251, and Japanese Utility Model Application Laid-Open Nos. 3-65754, 3-65755 and 3-119054, none of these conventional devices teach the increase of the angling angle.

SUMMARY OF THE INVENTION

The present invention is provided to eliminate the above-discussed disadvantages or drawbacks of the conventional devices, and to provide a blade device that ensures good work efficiency and good transportability by increasing the angling angle and making the width of a blade at a maximum angling smaller than the width of a chassis without setting a mount position of the blade too far from the chassis.

The present invention, in its first aspect, provides a blade device which includes a frame located ahead of a chassis capable of swinging upward or downward, and a blade connected to a leading center of the frame through a joint. The connection between the frame and the blade is by way of a joint which is located at a position which deviates from a depth-wise center of the chassis. Another joint is disposed above the joint; and an actuator which has one end attached to the blade at a position opposite to the joint with respect to the depth-wise center of the chassis, while the other end thereof is attached to the frame at a position which is at the same side of the depth-wise center of the chassis as the joint.

The blade is pivotally moved forward or backward about the joint and the another joint by extension and contraction of the actuator. The blade device may be constructed in such a way that a horizontally rotatable link mounted on a center bracket extending upward from the frame and a tilt actuator are connected between the another joint and the frame so that the link is connected at a one end thereof to the another joint, while another end thereof is connected to one end of the tilt actuator, the other end of which is connected to the frame so that the blade is twistable as a result of the rotation of the link caused by extension and contraction of the tilt actuator.

According to such a structural arrangement, the mount position of the joint as the center of the forward and backward pivot motions of the blade deviates from the center of the chassis in the width direction. In other words, when the angling actuator for pivoting the blade forward and backward is extended, the crosswise end surface of the blade on the side, on which the joint is mounted, pivots by a short distance. Therefore, since the crosswise end surface of the blade does not interfere with the chassis, wide angling is made possible and operability of a dumping operation or the like is enhanced without setting the joint mount position, (i.e., the blade position) too far from the chassis. In addition, since the blade width can be smaller than the chassis width in a state in which the angling angle is wide, it can fall within the chassis width when the blade is in a transport position; thereby, enhancing transportability. Furthermore, since one end of the angling actuator is attached to the blade at the position opposite to the joint, the angling actuator having only small power can bear the load on the blade in a dozing operation or the like.

More particularly, when the angling actuator is mounted in such a way that the extending and contracting direction thereof is similar to the blade width direction, the pivot amount of the blade, with respect to the extending and contracting amount of the angling actuator, can be increased. Since the extending amount (stroke) of the actuator is subsequently prevented from significantly increasing, even at the maximum angling angle, the actuator (e.g., an extending and contracting rod) is not buckled. Although two angling actuators of the above-mentioned types are normally mounted in the conventional device which makes such conventional machine a little larger, one actuator serves just as well; thereby reducing the production cost, as well as any required accessories. Furthermore, greater angling angle is obtainable because the angling actuator is attached to the frame at the same side as the joint. The provision of the tilt actuator enables the blade to tilt as a result of extension and contraction of such a tilt actuator.

The present invention in its second aspect provides a blade device having a frame located ahead of a chassis capable of swinging upward or downward; and a blade connected to the leading center of the frame through a joint. The connection between the frame and the blade is achieved by a joint which is located at a position which deviates from the depth-wise center of the chassis, another joint disposed above the joint, and an actuator having one end attached to the blade at a position opposite to the joint with respect to the depth-wise center of the chassis and the other end attached to the frame. A connecting member is mounted between at least one of the blade and the frame and the adjacent end of the actuator through a plurality of mounting members, at least one of the mounting members being detachable. The blade is further swung forward by pivoting the connecting member after removing the detachable mounting member.

According to such a structural arrangement, when the angling actuator is connected by the connecting member through mounting members (e.g., pins), the angling angle can be increased and the blade width can be made smaller than the chassis width by removing a detachable mounting member after extending the actuator, and further moving one end of the blade forward manually or by other means. Consequently, transportability of this invention can be improved. The above operation can be obtained by mounting the connecting member between the angling actuator, and the blade and/or the frame as needed.

These and other features of the invention will be understood upon reading of the following description, along with the drawings.

DETAILED DESCRIPTION OF THE PREFERRED EMBODIMENTS

Figure 1:
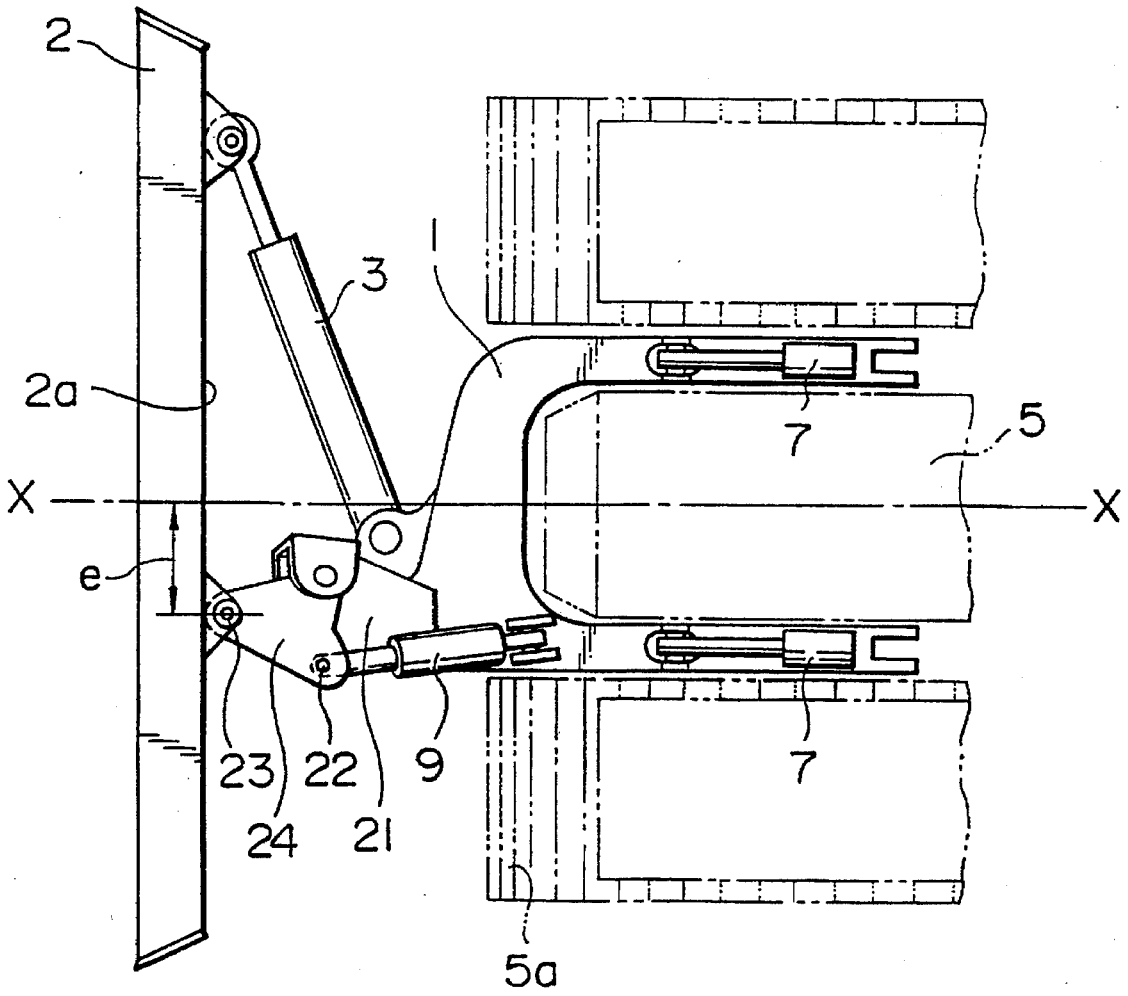
FIG. 1 is an explanatory plan view showing a blade device according to a first embodiment of the present invention.
Figure 2:
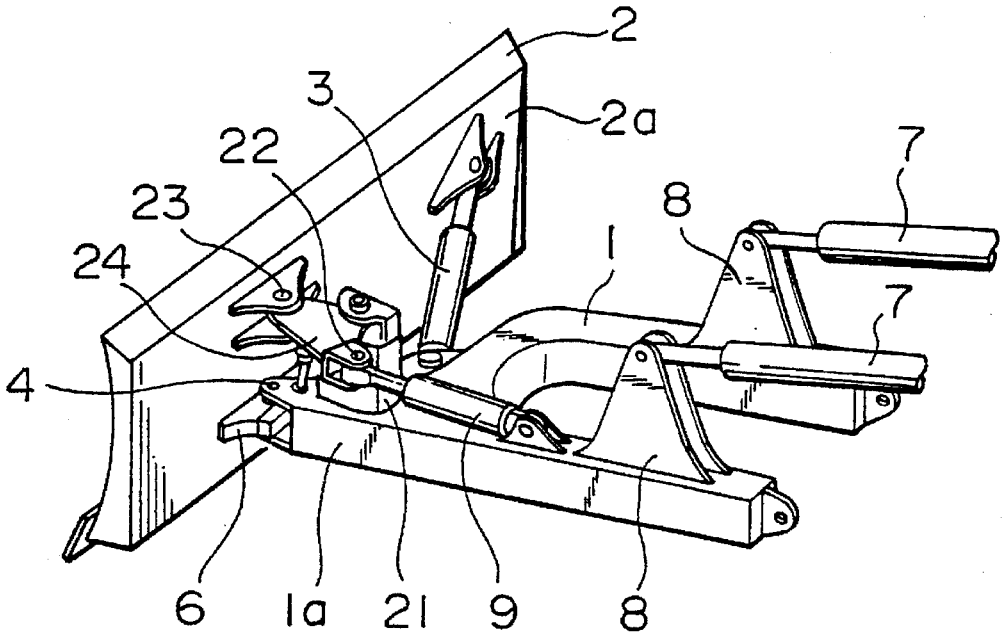
FIG. 2 is a perspective view of the blade device shown in FIG. 1.
Figure 3:
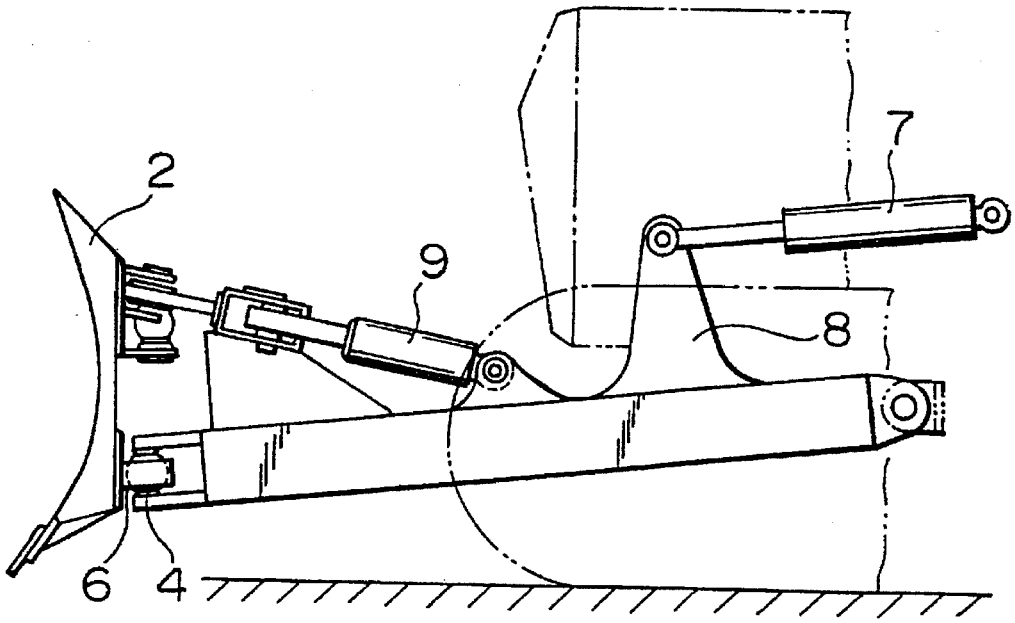
FIG. 3 is an explanatory view showing an elevational side view of FIG. 1.

FIGS. 1 to 3 show a blade device of a first embodiment of the present invention. Here, an open base end of a frame 1 is pivotally mounted ahead of a chassis 5 of a bulldozer, as an earth moving machine, to which the present invention is applied. The front portion of the frame 1 is asymmetrical with respect to a crosswise center line X—X (see, FIG. 1) of the chassis 5, and the left side thereof forms a projecting portion la that projects forward. The leading end of the projecting portion la and a boss 6 fixed on a blade 2 are connected through a pivotal joint 4, by which the blade 2 can pivot about the joint 4. The position of the joint 4 deviates from the crosswise center line X—X of the blade 2 to the left by a distance e.

The base end of an angling actuator 3 is pivotally attached to the root of the projecting portion 1*a* of the frame 1, and the leading end thereof is pivotally attached to the right end of a back surface 2*a* of the blade 2. A pair of lifting actuators 7 for moving the frame 1 up and down are pivotally attached to the chassis 5 at the base ends thereof, and pivotally attached to the tops of brackets 8, which stand on the upper surface of the frame 1, at the leading ends thereof.

A tilting actuator 9 is provided between the frame 1 and the blade 2, pivotally attached to the left side of the frame at the base end thereof, and connected to the blade 2 through a link 24 at the leading end thereof. This link 24, having a substantially triangular shape, is mounted on a center bracket 21, which stands on the projecting portion la, through a joint at a first point thereof, mounted on the back surface 2*a* of the blade 2*a* through a joint 23 above the joint 4 at a second point thereof, and mounted on the leading end of the tilting actuator 9 through a joint 22 at a third point thereof. These joints at the respective points can pivot. The blade 2 is tilted through the link 24 by extending and contracting the tilting actuator 9. Reference numeral 5*a* in FIG. 1 denotes crawler belts.

Figure 4:
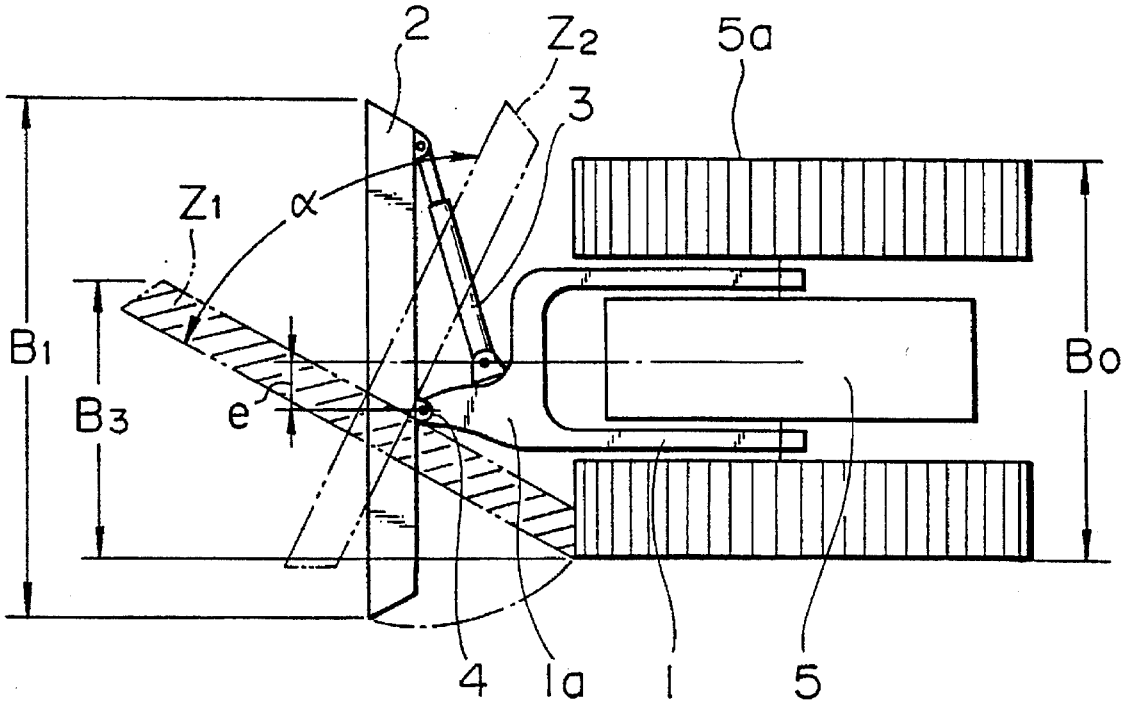
FIG. 4 is a view for explaining the actuation of angling in the first embodiment.
Figure 14:
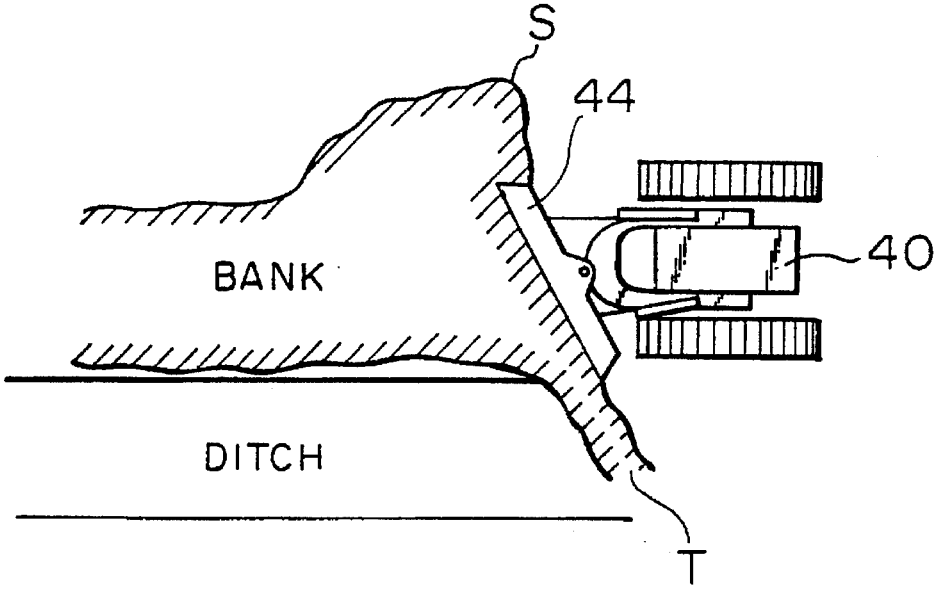
FIG. 14 PRIOR ART
FIG. 14 is an explanatory plan view showing the problem caused by a small angling angle in the conventional device.

According to such a structural arrangement in relation to actuation, as shown in FIG. 4, the blade 2 is pivoted about the joint 4, forward and backward, by extending and contracting the angling actuator 3. A pivot angle α between a blade position Z1 at the maximum stroke of the angling actuator 3 and a blade position Z2 at the minimum stroke is wider than before. The operator can select the angling angle best-suited to the operation according to the property of the earth, sand or the like. For example, when the blade 2 is adjusted to the position Z1 or a position close thereto and a ditch backfilling operation is performed, since the angling angle is wide, high workability can be obtained by good flow of earth and sand, and the earth and sand windrow or the like (see, FIG. 14) in the conventional devices are significantly inhibited. Furthermore, since a width B3 of the blade 2 at the position Z1 is smaller than a chassis width BO and the blade 2 does not stick out from the crawler belts 5*a*, the machine with the attached blade 2 can be loaded on a truck or the like having a rear deck that is narrow. Therefore, man-hours to attach and detach the blade 2 are unnecessary, and good transportability can be attained.

Next, a blade device according to a second embodiment of the present invention will be described in reference to FIGS. 5 and 6. This embodiment differs from the first embodiment in the position of the angling actuator. Although the illustration and description of a lifting actuator and a tilting actuator for the blade 2 are omitted, the actuator shown in FIG. 1 or a general type actuator used conventionally is mounted.

Figure 5:
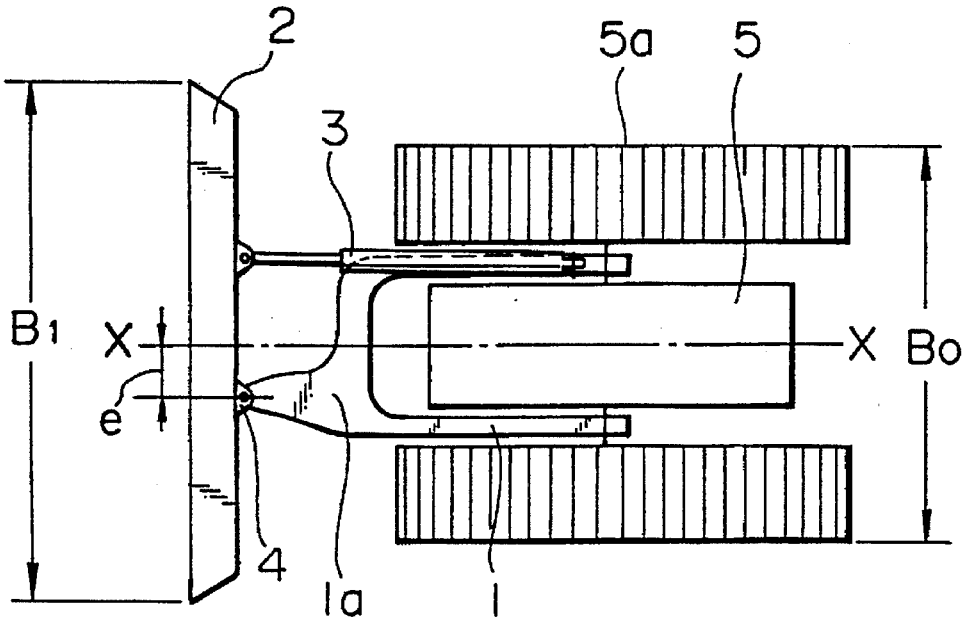
FIG. 5 is an explanatory plan view for showing a blade device according to a second embodiment of the present invention.
Figure 6:
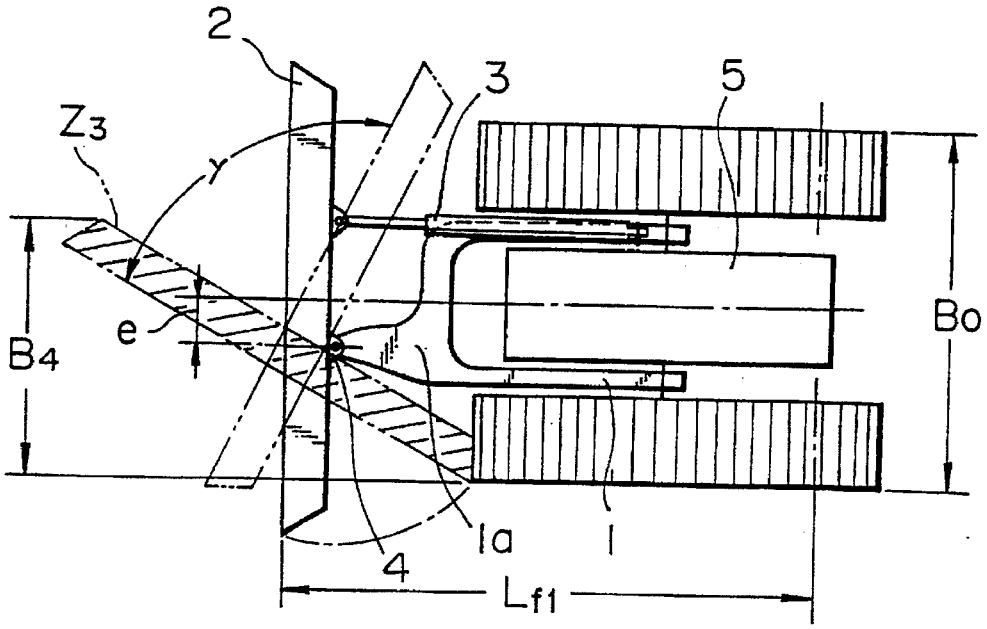
FIG. 6 is a view explaining an angling operation in the second embodiment.

In FIG. 5, a joint 4 between a projecting portion 1*a* of a frame 1 and a blade 2 is mounted at a position deviated from a center line X—X to the left by a distance e in the same manner as in the first embodiment. On the right side opposite to the joint 4 relative to the center line X—X, an angling actuator 3 for connecting the frame 1 and the blade 2 is placed through a joint. This placement is provided in such a way that the angling actuator 3 is at about right angles to the blade 2 having an angling angle that is almost 20°. The maximum stroke of the angling actuator 3 is set larger than the conventional one. A blade width B1 at an angling angle of 0° is, similar to the first embodiment, wider than a chassis width B0.

Figure 15:
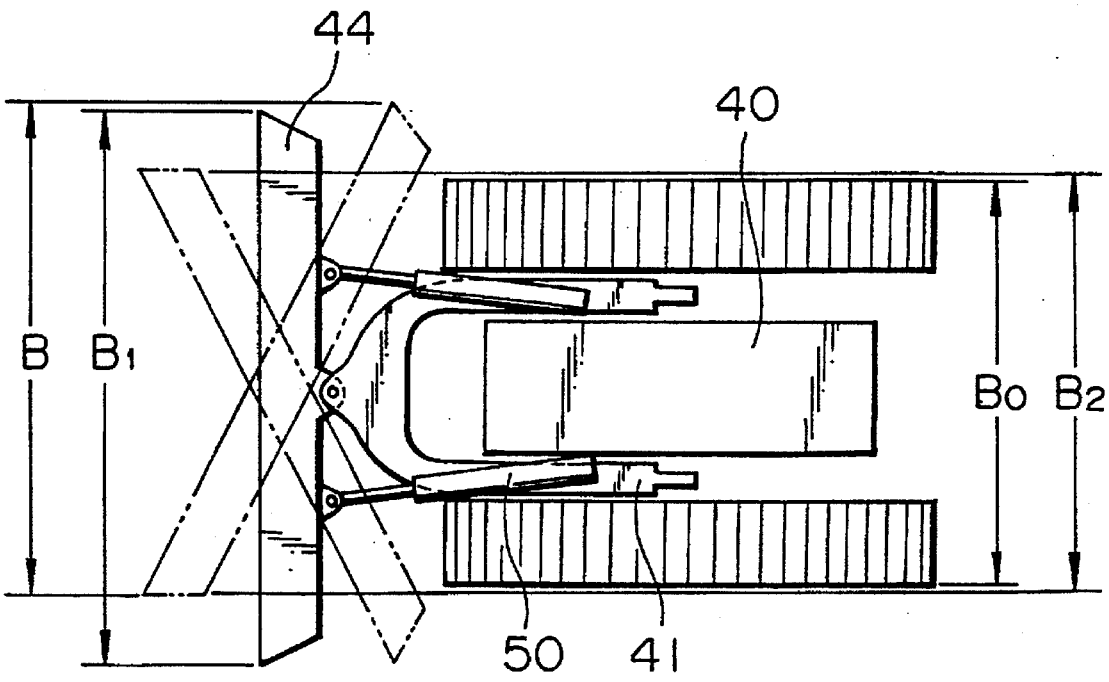
FIG. 15 PRIOR ART
FIG. 15 is an explanatory plan view showing the problem in transportability of the conventional earth moving machine when a blade is attached.
Figure 16:
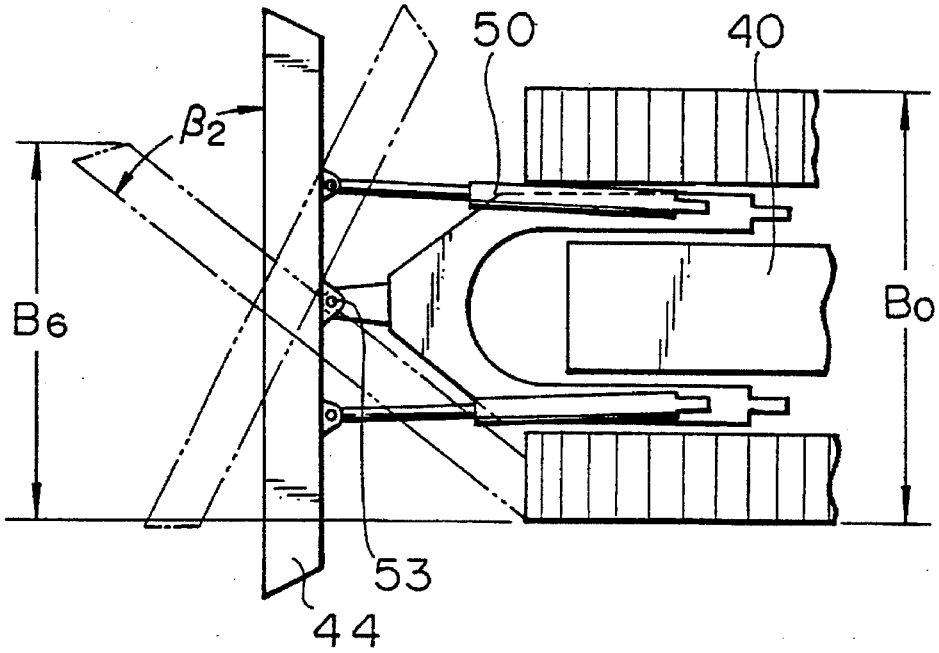
FIG. 16 PRIOR ART
FIG. 16 is an explanatory plan view showing the problem inherent in a wide angling angle in the conventional blade device.
Figure 17:
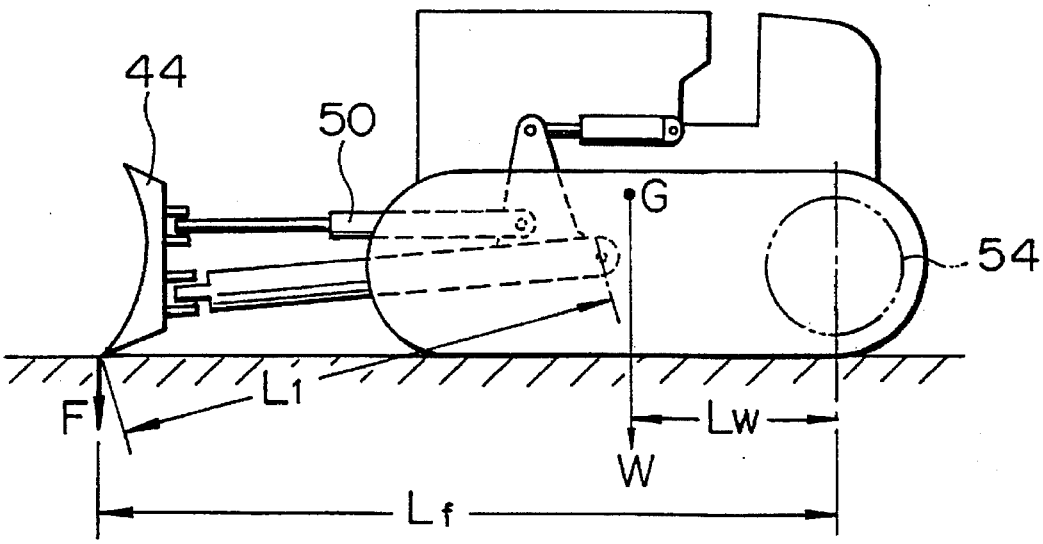
FIG. 17 PRIOR ART
FIG. 17 is an explanatory side view of FIG. 16.

According to such a structural arrangement (see, also, FIG. 6 which explains the actuation), since the blade 2 can obtain a wide pivot angle γ about the joint 4 by extending and contracting the angling actuator 3, the operation in a wide-angle range is possible. Furthermore, since a width B4 of the blade 2 at a position Z3 is smaller than the chassis width BO, the same effects as in the first embodiment (such as, improved working performance and transportability) can be obtained. A distance Lf1 from the center of a drive tumbler to the leading end of the blade 2 is slightly longer when compared to that of the conventional machine shown in FIG. 15, and, as a countermeasure, much shorter than the distance Lf of the conventional machine as shown in FIG. 17. The short distance Lf1 prevents a blade edge force F (see, FIG. 17) from decreasing in the same manner as in the first embodiment.

Although one angling actuator is used in the above description of the first and second embodiments, such a structural arrangement can achieve stable holding of the blade; and the angling operation is performed without difficulty. Furthermore, since the number of angling actuators to be mounted is less than two, the conventional number, it is possible to significantly reduce the production cost.

Next, a blade device according to a third embodiment of the present invention will be described with reference to FIGS. 7 and 8. This embodiment differs from the second embodiment in the means for connecting the angling actuator and the blade.

Figure 7:
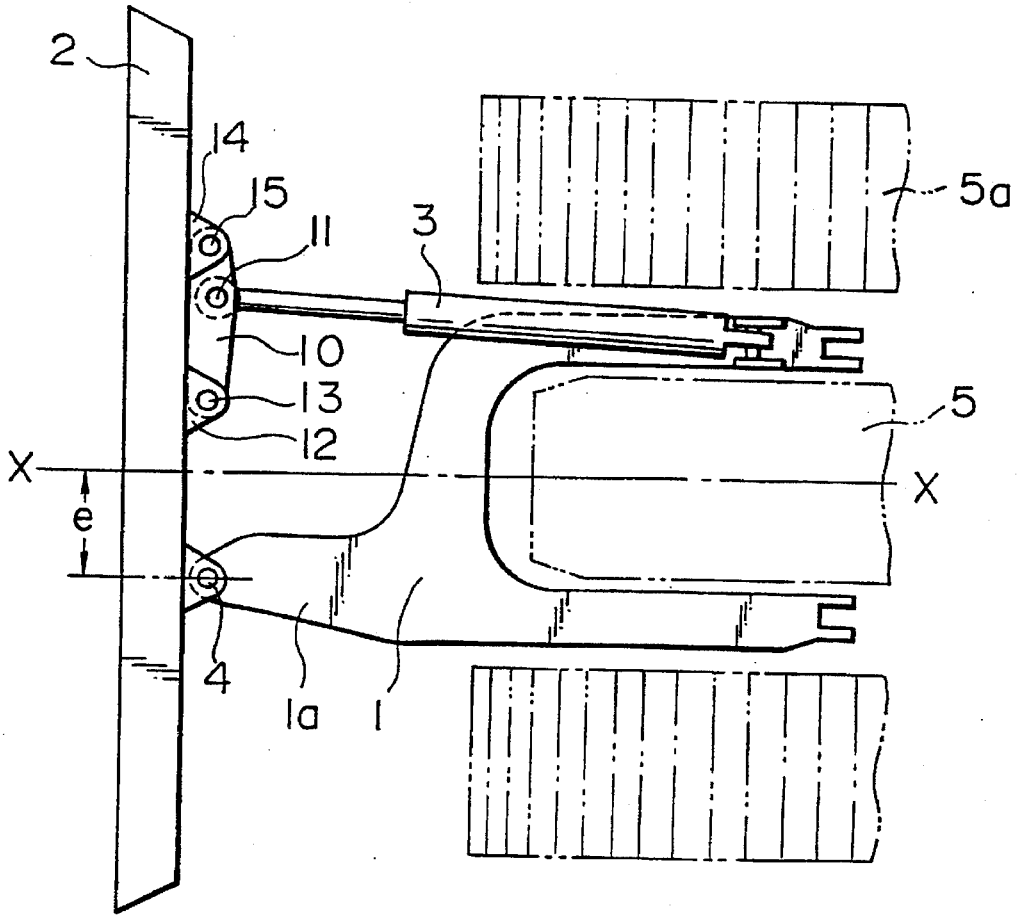
FIG. 7 is a schematic plan view of a blade device according to a third embodiment of the present invention.
Figure 8:
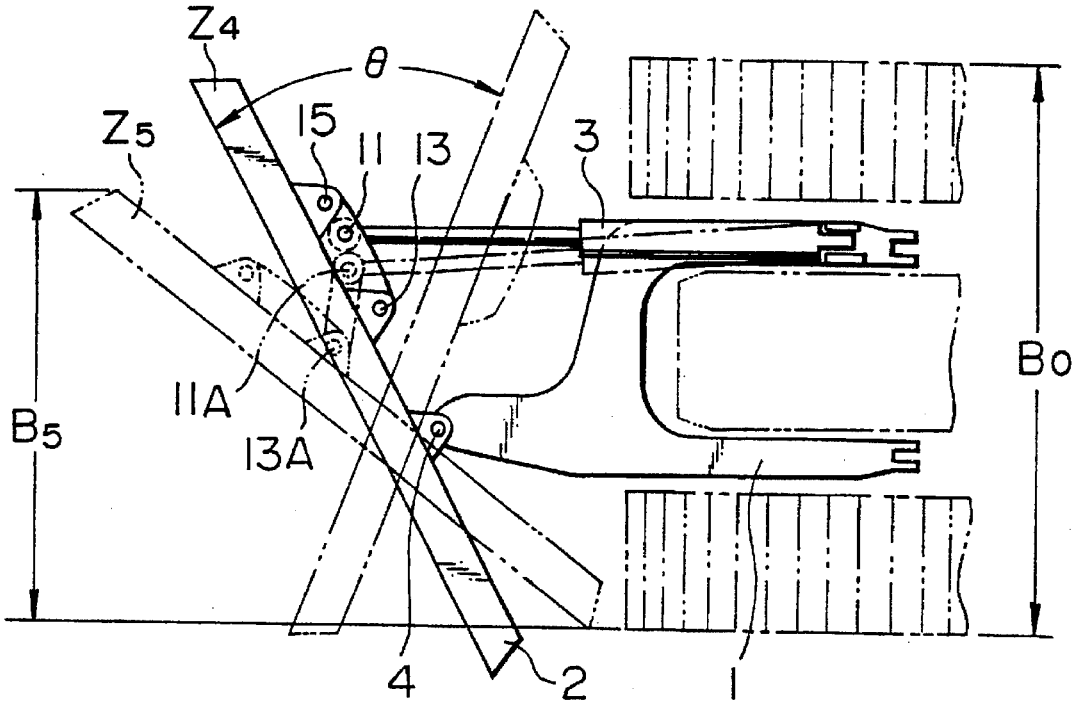
FIG. 8 is a view explaining an angling operation in the third embodiment.

In reference to FIG. 7, a joint 4 for connecting a frame 1 and a blade 2 deviates from a crosswise center line X—X of a chassis 5 to the left by a distance e in the same manner as in the first embodiment. An angling actuator 3, which is pivotally mounted on the frame i at the base end thereof, and brackets 12 and 14 fixed on the rear surface of the blade 2 are connected through a lever 10 as a connecting member. This lever 10 is mounted through pins as an example of a mounting member. In other words, the lever 10 is pivotally mounted on the bracket 12 through a pin 13 at one end thereof, detachably mounted on the bracket 14 through a pin 15 at the other end thereof, and pivotally mounted on the leading end of the angling actuator 3 through a pin 11 at about the center thereof.

According to such a structural arrangement (see, also, FIG. 8 which explains the actuation), when the angling actuator 3 is extended or contracted to the maximum or minimum stroke, the blade 2 pivots about the joint 4. A pivot angle θ represents a pivot range. The pivot angle e can be set wider than the conventional blade pivot angle; and therefore, the operation range is wider than before. Next, when the blade 2 is pivoted to a position Z5, manually or by another means, after drawing out the pin 15 at a blade position Z4 corresponding to the maximum stroke of the angling actuator 3, the pins 11 and 13 move to pins 11A and 13A. A blade width B5 at this position Z5 is smaller than a chassis width BO; and therefore, good transportability can be obtained in the same manner as in the above embodiments, in this embodiment, the maximum stroke of the angling actuator 3 may be shorter than that of the second embodiment.

Next, a blade device according to a fourth embodiment of the present invention will be described in reference to FIGS. 9 and 10. This embodiment differs from the second embodiment in the means for connecting the angling actuator and the frame.

Figure 9:
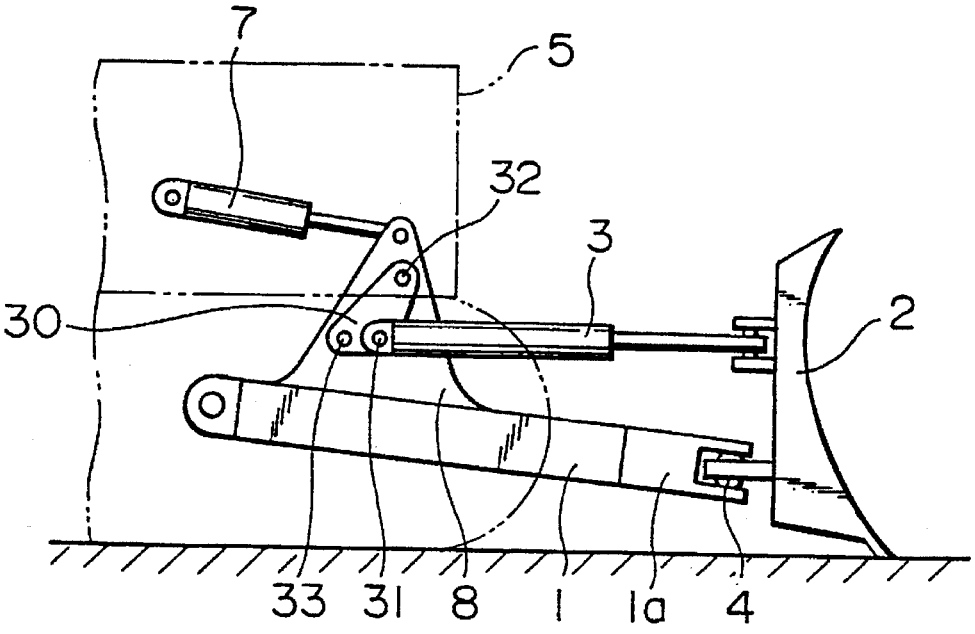
FIG. 9 is a schematic side view of a blade device according to a fourth embodiment of the present invention.
Figure 10:
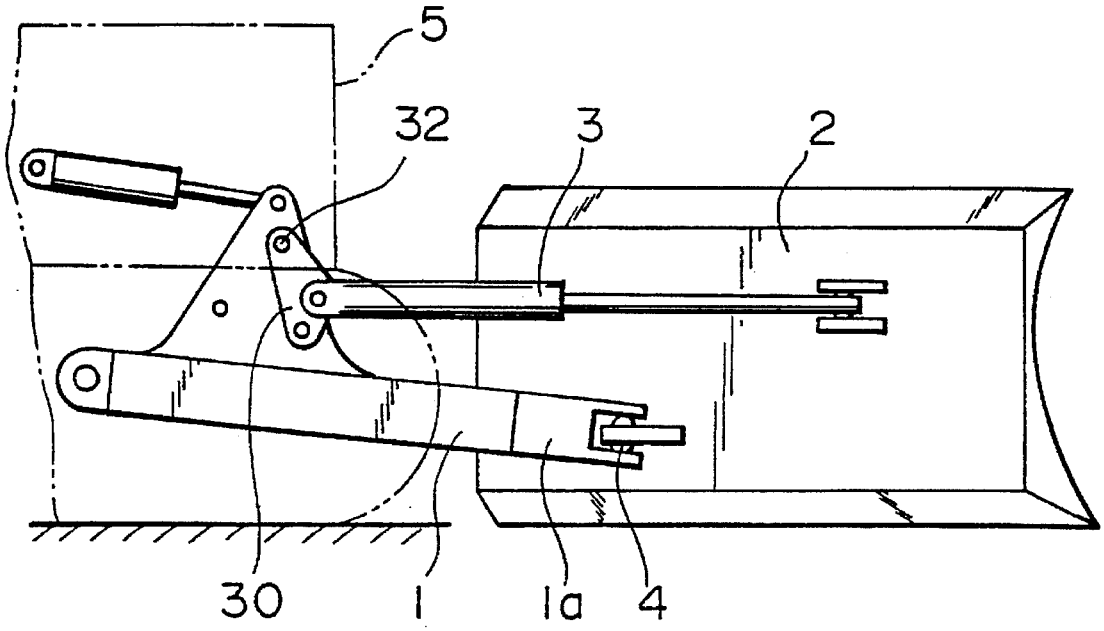
FIG. 10 is a schematic side view of the blade device of the fourth embodiment which is being angled.
Figure 11:
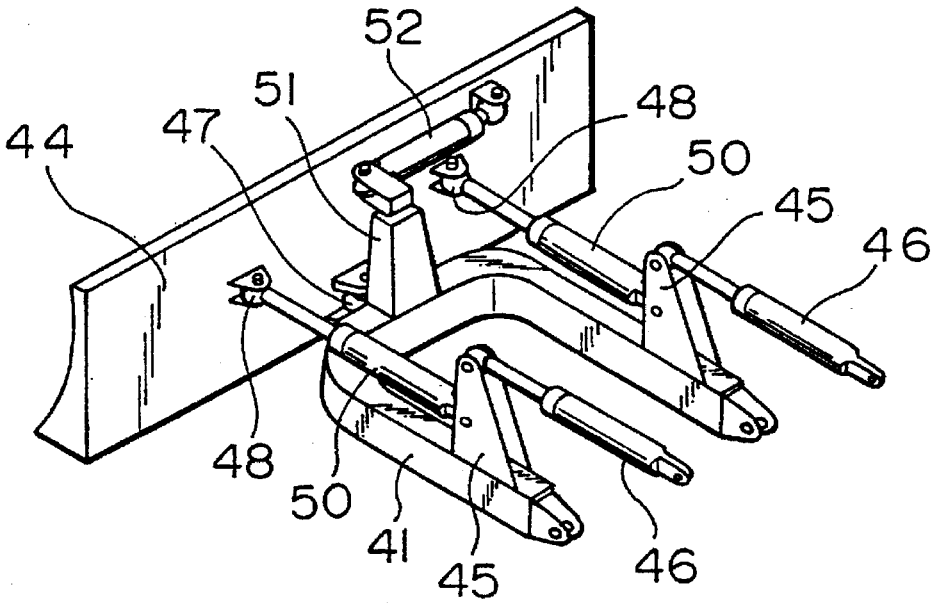
FIG. 11 PRIOR ART
FIG. 11 is an explanatory perspective view of a conventional blade device.
Figure 12:
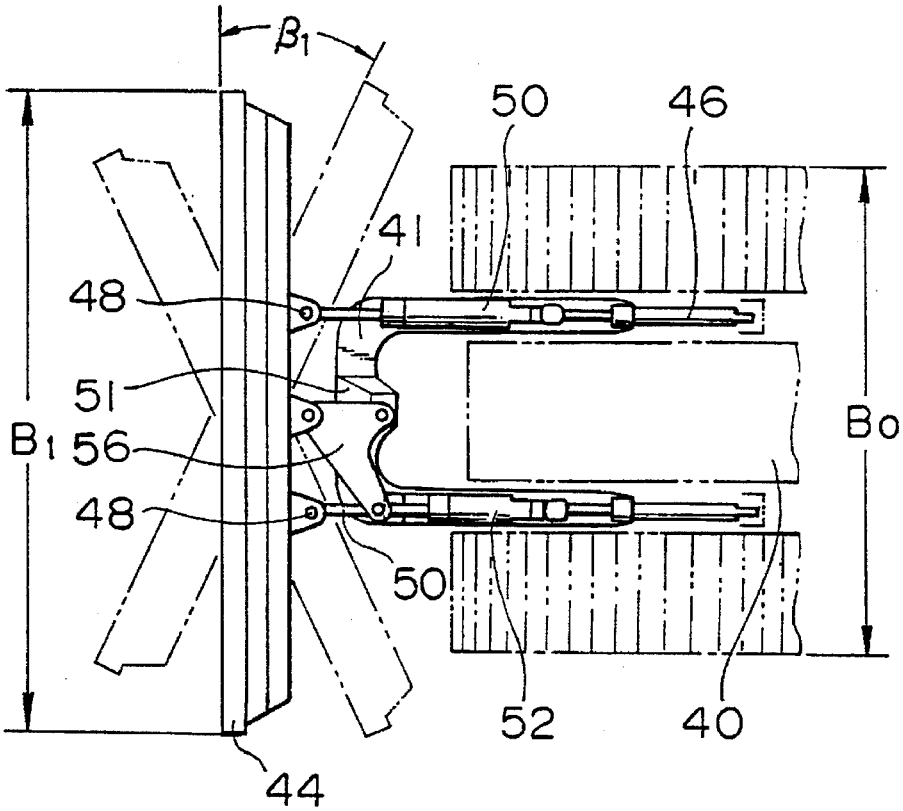
FIG. 12 PRIOR ART
FIG. 12 is an explanatory plan view of another conventional blade device.
Figure 13:
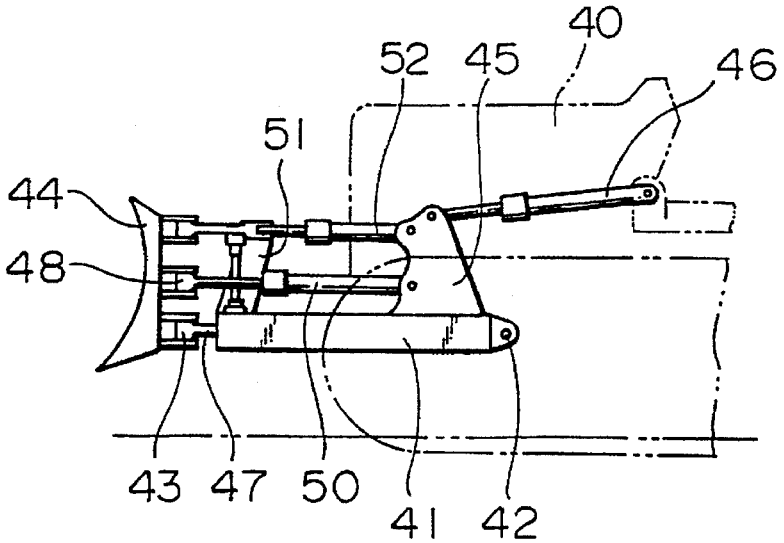
FIG. 13 PRIOR ART
FIG. 13 is an explanatory view showing an elevational side view of FIG. 12.

In reference to FIG. 9, a bracket 8 fixed on a frame 1 and a chassis 5 are connected by a lifting actuator 7. An angling actuator 3 is pivotally mounted on a blade 2 at the leading end thereof, and connected to the bracket 8 at the base end thereof through a lever 30 as a connecting member. This lever 30 is mounted through pins as an example of a mounting member. In other words, the lever 30 is pivotally mounted on the bracket 8 through a pin 32 at one end thereof, detachably mounted on the bracket 8 through a pin 33 at the other end thereof, and pivotally mounted on the base end of the angling actuator 3 through a ball and socket joint 31 at about the center thereof. The position of a joint 4 between a projecting portion 1*a* of the frame 1 and the blade and the connecting position of the angling actuator 3 and the blade 2 deviate from the crosswise center of the chassis in the same manner as in the above embodiments.

According to such a structural arrangement, the blade 2 is pivoted forward and backward by extending and contracting the angling actuator 3, as in the above embodiments, and the pivot angle is wider than before. When the pin 33 is drawn out in a state in which the actuator 3 is extended to the maximum stroke, the lever 30 is allowed to pivot about the pin 32. The angling angle can further be increased by further moving the right side of the blade 2 ahead of the chassis 5, manually or by another means, as shown in FIG. 10. The blade width in this state is larger than the chassis width BO in the same manner as in the state (BS) shown in FIG. 8, and transportability is thus improved. In this embodiment, like the third embodiment, the maximum stroke of the angling actuator 3 may be shorter than the maximum stroke of the second embodiment. Therefore, workability and transportability can be enhanced without substantially increasing the stroke of the angling actuator 3.

Although the embodiments of the blade device according to the present invention have been described in detail above, the present invention is not limited to the above-mentioned embodiments. Since it is only necessary that the mount position of the joint functioning as the center of the forward and backward blade pivot motions deviates from the center of the chassis in the width direction, which side in the width direction and what deviation distance e may be selected as needed. Furthermore, mounting of two angling actuators can also achieve the objective of the present invention, and is useful. With respect to the mount positions of one or more angling actuators to be mounted, the positions for connecting the base and leading ends of the angling actuators, and the frame and the blade may be set as needed (e.g., at a position deviated on the same side as the joint as the center of the blade pivot motion, or the center position in the width direction). The connecting member may be provided between the angling actuator and the blade and/or between the angling actuator and the frame. When the connecting member is provided in both the above positions, the amount of pivoting, manually or by another means, is further increased. As the actuator, e.g., an angling actuator, a hydraulic cylinder, a motor (such as, a hydraulic motor) or the like may be used.

Since the present invention can increase the angling angle of the blade and make the blade width at the maximum angling smaller than the chassis width, such structural arrangement is useful as a blade device in an earth moving machine that has good workability and transportability.

We claim:

1. A blade device, comprising:

a frame located ahead of a chassis capable of swinging upward or downward; and a blade connected to a leading center of said frame through a first joint, wherein a connection between said frame and said blade is comprised of said first joint which is located at a position that deviates from depth-wise center of said chassis, a second joint disposed above said first joint, and an actuator having one end attached to said blade at a position opposite to said first joint with respect to the depth-wise center of said chassis and the other end attached to said frame at a position which is at the same side of the depth-wise center of said chassis as said first joint, wherein said blade is capable of pivotally moving forward or backward about said first joint and said second joint by extension and contraction of said actuator.

2. A blade device, comprising:

a frame located ahead of a chassis capable of swinging upward or downward; and a blade connected to a leading center of said frame through a first joint, wherein connection between said frame and said blade is comprised of said first joint which is located at a position that deviates from a depth-wise center of said chassis, a second joint disposed above said first joint, and an actuator having one end attached to said blade at a position to said first joint with respect to the depth-wise center of said chassis and the other end attached to said frame, wherein a connecting member is mounted between at least one of said blade and said frame and the adjacent end of said actuator through a plurality of mounting members, at least one of said mounting members being detachable, and wherein said blade is capable of being further swung forward by pivoting said connecting member after removing said detachable mounting member.

3. A blade device according to claim 2, further comprising a horizontally rotatable link mounted on a center bracket extending upward from said frame and a tilt actuator provided between said second joint and said frame such that said link is connected at one end thereof to said second joint and another end thereof to one end of said tilt actuator the other end of which is connected to said frame, wherein said blade is tiltable as a result of rotation of said link caused by extension and contraction of said tilt actuator.

* * * * *